United States Patent [19]

Wilson

[11] 4,171,024

[45] Oct. 16, 1979

[54] POWER HAMMER

[76] Inventor: Roger A. Wilson, P.O. Box 23, Clarissa, Minn. 56440

[21] Appl. No.: 865,746

[22] Filed: Dec. 29, 1977

[51] Int. Cl.[2] ..... B25D 9/00

[52] U.S. Cl. ..... 173/117; 173/119; 173/123; 173/133

[58] Field of Search ..... 173/117, 119, 120, 123, 173/124, 133, 104, 109

[56] References Cited

U.S. PATENT DOCUMENTS

| | | | |
|---|---|---|---|
| 1,029,824 | 6/1912 | Rodrigues | 173/119 |
| 1,925,289 | 9/1933 | Strobel | 173/123 |
| 2,492,840 | 12/1949 | Bugg | 173/119 |
| 2,888,246 | 5/1959 | Sieber | 255/39 |
| 3,256,946 | 6/1966 | Jansen et al. | 173/123 |
| 3,924,692 | 12/1975 | Saari | 173/117 |
| 4,082,152 | 4/1978 | Whitworth | 173/119 |

*Primary Examiner*—Lawrence J. Staab
*Attorney, Agent, or Firm*—Orrin M. Haugen; Thomas J. Nikolai

[57] ABSTRACT

A power hammer having an elongated hammer element disposed in a tubular housing for reciprocating motion therein and having a cylindrical cam concentrically mounted with respect to the tubular housing for displacing the hammer element against the force of a compression spring. When a point in the cam profile is reached which drops off abruptly, the hammer element is driven against an anvil member also disposed in the tubular housing. The cam is adapted to be driven by either an electric motor or another suitable source of rotational power.

8 Claims, 4 Drawing Figures

Fig. 1
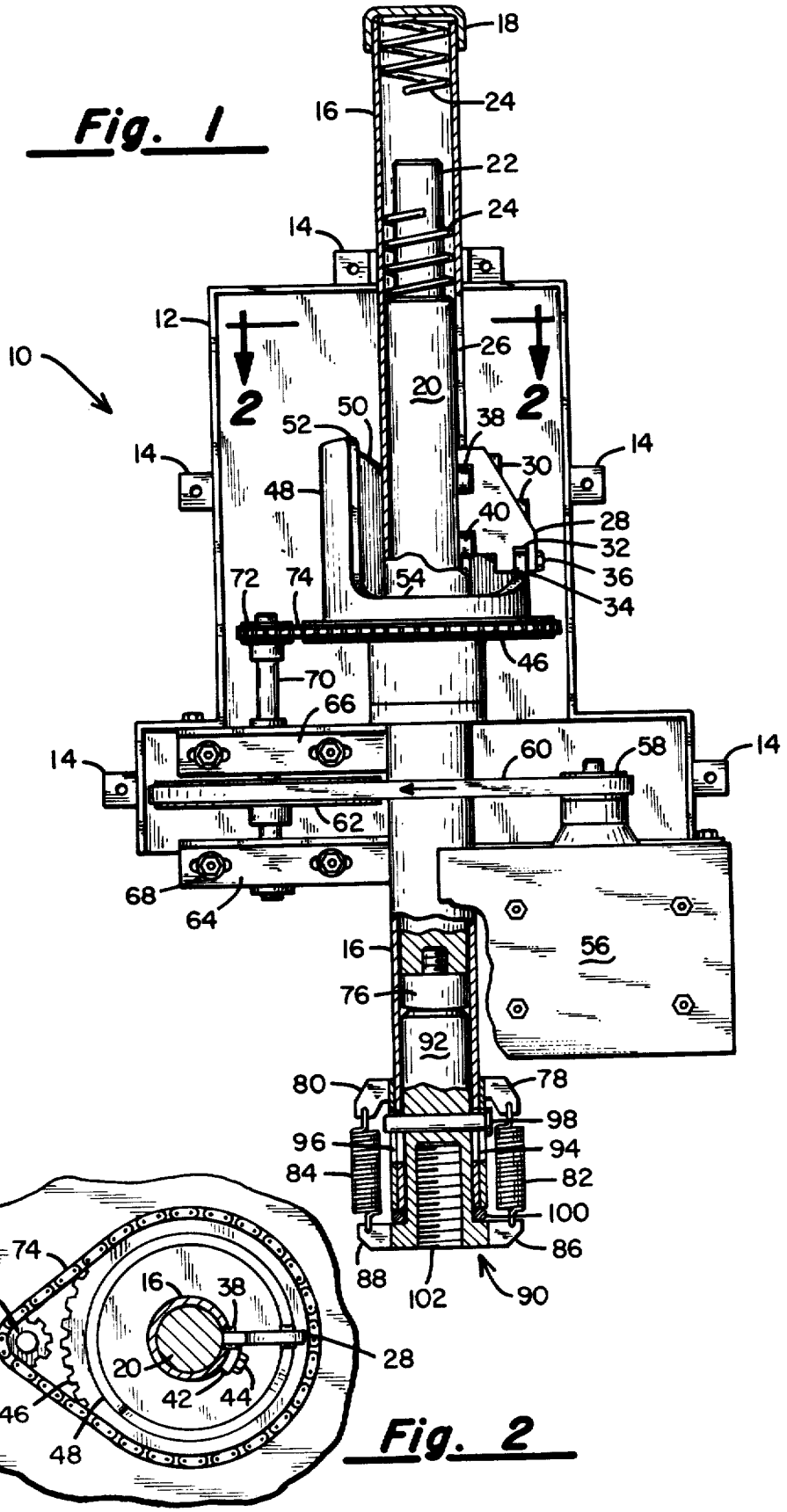
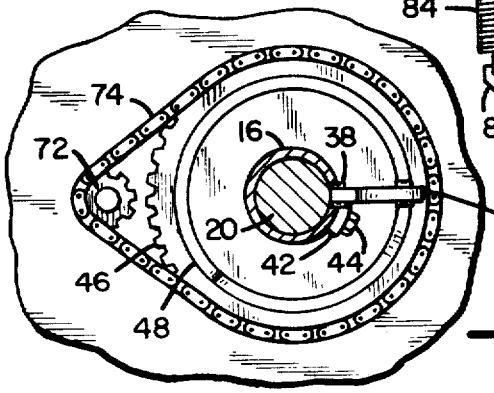
Fig. 2

POWER HAMMER

BACKGROUND OF THE INVENTION

I. Field of the Invention

This invention relates generally to a power tool and more specifically to a power hammer which may be utilized for driving posts, drilling in rock and concrete, forming metal and similar heavy duty applications.

II. Description of the Prior Art

Various designs for power impact tools are described in the prior art. Generally, prior art devices incorporate a reciprocally mounted, spring biased hammer element which is lifted by a rotating cam against the force of the spring and suddenly permitted to drop by virtue of an abrupt shoulder formed in the cam profile. Examples of such arrangements are set forth in the Kollock U.S. Pat. No. 1,712,456; the Grutzbach U.S. Pat. No. 1,798,082; the Sheldon U.S. Pat. No. 2,501,542; the Gibson U.S. Pat. No. 2,646,100 and the Morishita et al U.S. Pat. No. 3,448,817. In each of the foregoing designs, the cam element is offset from the longitudinal axis of the impact hammer which is a serious disadvantage in that undue stress is placed upon the bearings supporting the cam for rotation. This, in turn, leads to frequent breakdown and costly repairs. Then too, the offset arrangement of the cam with respect to the reciprocating hammer tends to produce noxious vibrations resulting in discomfort to the operator and fatigue.

In the design of the present invention, the hammer displacing cam is concentrically positioned about the housing containing the elongated hammer element rather than being offset therefrom. It has been found that this design approach considerably reduces vibrations and also considerably reduces wear on the bearings supporting the cam for rotation.

The design of the power hammer of the present invention also utilizes a unique anvil assembly arrangement which is mounted on the same housing used to contain the reciprocating hammer element. The anvil element is arranged to accept a variety of tools such as chisel bits, striking heads, etc. and is arranged for limited travel upon being impacted by the hammer element. Further, cushioning means are disposed between the anvil element and the housing to further reduce noxious vibration during use.

It is accordingly the principal object of the present invention to provide a new and improved design for a power impact tool.

Another object of the invention is to provide a power impact tool in which a cam operated hammer element is concentrically mounted with respect to the cam.

Another object of the invention is to provide an impact tool which may normally be driven from an electric motor, but which may be simply converted to operate from a non-electric source of rotary power such that the tool may be used in locations where electricity may not be available.

SUMMARY OF THE INVENTION

In accordance with the teachings of the present invention, the foregoing objects are attained through the novel features of construction heretofore alluded to and which are fully set forth in the following detailed description of the preferred embodiment. In its simplest form, the power hammer of the present invention comprises a tubular housing having a closed first end and an open second end. Located within this tubular housing is an elongated hammer element and a compression spring is arranged coaxially with the hammer element between the closed end of the housing and the non-impacting end of the hammer element. A cylindrical cam having a predetermined cam profile formed thereon is concentrically mounted on a turntable which surrounds the tubular housing and the turntable is adapted to be driven by either an electric or a non-electric source of rotational power. A slot is provided in the housing and passing through this slot is a cam follower which is secured to the elongated hammer element. The cam follower includes a roller bearing which cooperates with the cam profile to raise the hammer element within the housing against the force of the aforementioned coil spring. Upon reaching a point in the profile where the surface of the cam suddenly falls away, the spring force rapidly displaces the hammer element so as to impart a striking force against an anvil which is partially contained within the tubular housing at the opened end thereof. The anvil element is spring supported with respect to the tubular housing and a stop member is provided for limiting the distance which the anvil may travel upon impact.

Other objects and features of the invention will be more fully and better understood by reference to the accompanying drawings in which like numbers refer to like parts in the several views.

DESCRIPTION OF THE DRAWINGS

FIG. 1 is a side elevation view of the preferred embodiment with a portion of the housing cover removed and partially cross-sectioned and broken away to reveal the working structure thereof;

FIG. 2 is a cross-sectional view taken along the section lines 2—2 in FIG. 1;

DESCRIPTION OF THE PREFERRED EMBODIMENT

Figure 3:
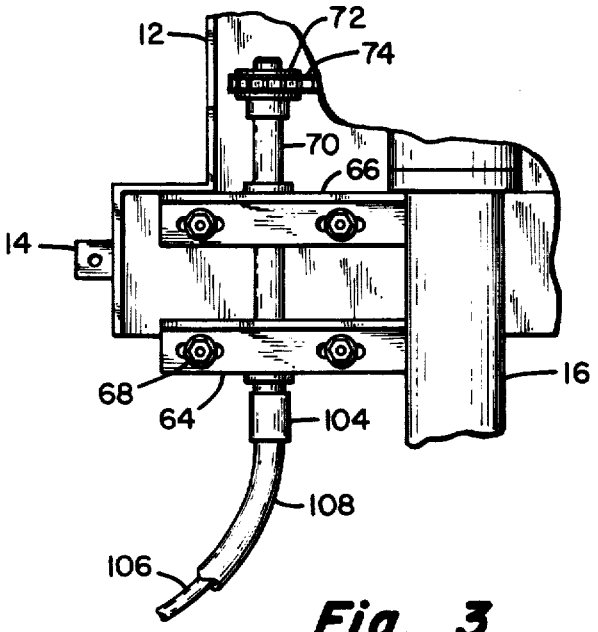
FIG. 3 is a fragmentary view showing the manner in which the power hammer may be driven from a flexshaft.

Referring first to FIG. 1, there is indicated generally by numeral 10 the power impact tool of the present invention. A cover 12 formed from sheet metal or other suitable material partially surrounds the operational elements of the device, the cover 12 being formed in two parts only one half of which is shown. The remaining portion of the cover 12 may be bolted in place by mating attachment to the ears 14 which are welded to or otherwise affixed to the cover half 12.

Partially contained within the enclosure defined by the cover 12 is an elongated tubular housing 16 which is sealed at its upper end by an end cap 18 and which is open at its opposite end. Contained within the tubular housing member 16 is an elongated hammer element 20 which is mounted for reciprocal travel within the tubular housing 16. While the hammer element 20 is depicted as a generally cylindrical steel rod, it may have a non-circular cross-section depending upon the corresponding configuration of the tubular housing 16.

At the upper end of the hammer element 20 is an integrally formed stem 22 of a reduced diameter and surrounding the stem 22 is a compression-type helical spring 24 which abuts the end cap 18 and the shoulder formed between the segments 20 and 22 of the hammer element 20. The coil spring 24 normally urges the hammer element 20 in the direction of the open end of the tubular housing 16.

An axial slot 26 formed in the side wall of the tubular housing member 16 and passing through this slot is a cam follower assembly indicated generally by numeral 28. The cam follower 28 is fixedly attached to the side surface of the hammer element 20 by means of machine bolts 30 to allow removal thereof for repair or replacements. The cam follower 28 has a notch 32 formed therein in which is disposed a roller member 34 which is mounted on a bolt 36 as an axis, the roller 34 extending outward from the notch 32 by a predetermined clearance distance.

The cam follower assembly 28 further includes two additional roller bearings 38 and 40 which are arranged to rotate on a horizontal axis. Referring now to the cross-sectional view of FIG. 2, it can be seen that there is attached to the housing 16, adjacent to the slot 26 a vertically extending wear bar 42 which is attached to the housing 16 by means of bolts 44. The rollers 38 and 40 are arranged to abut the side surface of the wear bar 42 adjacent to the slot 26.

Journaled to the tubular housing 16 and rotatable thereabouts is a turntable 46 on which is mounted a cylindrical cam 48, the cam 48 being concentric with the housing 16. The cam 48 has a cam profile formed on the surface thereof and the cam profile is arranged to abut the roller member 34 on the cam follower 28. It may be observed that the cam profile includes a gradual rising segment 50 terminating in an abrupt edge 52 which falls to a lowermost level 54. Thus, as the cylindrical cam 48 is driven in a clockwise direction, the cam follower 28 will move upward in the slot 26, thereby compressing the spring 24 and when the abrupt edge 52 is reached, the cam follower will have the upward driving force removed from it and will fall against the lowermost flat surface 54, allowing the coil spring 24 to rapidly thrust the hammer element downward. The transverse force exerted on the cam follower 28 during the rising portion of the cycle is counteracted by the action of the roller members 38 and 40 abutting the edge of the wear bar 42 adjacent to the slot 26.

In order to drive the power hammer of the present invention there is shown in FIG. 1 a source of motive power, such as an electric motor, indicated generally by numeral 56. In either event, the source of rotational power drives a pulley 58 in a clockwise direction. A V-belt 60 couples the pulley 58 to a second pulley 62 which is journaled for rotation in a pair of pillow blocks 64 and 66 in a conventional fashion. The tension on the belt 60 may be adjusted by virtue of the slotted hole arrangement in the pillow blocks 64 and 66 through which the clamping bolts 68 pass. The pulley 62 is secured to a jack shaft 70 which has a sprocket 72 connected to its upper end. The sprocket 72 is coupled to the turntable 46 by means of a drive chain 74. The rate at which the turntable 46 and therefore the cylindrical cam 48 rotates is determined by the relative sizes of the pulleys 58–62 and the sprockets 72–46. It is, of course, possible to replace the chain 74 with a V-belt if the turntable 46 is provided with a V-notch and corresponding V-belt pulley is used in place of the sprocket 72 on the jack shaft 70.

Threadedly secured to the lower end of the elongated hammer element 20 is a replaceable drive head 76.

Attached to and extending radially from the tubular housing member 16 are projections 78 and 80. Tension springs 82 and 84 are secured at one end thereof individually to the projections 78 nd 80 and the other ends of the springs are secured to projections 86 and 88 formed on the lower end of an anvil assembly indicated generally by numeral 90. The anvil assembly 90 has a cylindrical portion 92 extending upward into the open end of the housing 16 so as to normally abut the driver head 76 when the cam follower roller 34 approaches the bottom of the cam profile identified by numeral 54. The springs 82 and 84 normally urge the cylindrical portion 92 of the anvil assembly 90 in the direction of the end cap 18.

In order to limit the travel of the anvil 90 upon impact from the hammer element 20, longitudinal slots 94 and 96 are formed on opposite sides of the tubular housing 16 and a pin 98 is arranged to pass through these slots and through a hole provided transversely through the anvil portion 92. When struck, the anvil will be driven outward from the open end of the housing 16 until the pin 98 engages the bottom of the slots 94 and 96.

A rubber O-ring 100 is disposed between the open end of the housing 16 and the extension of the anvil assembly 90 which projects beyond the open end of the housing. An axial bore 102 which is internally threaded is provided in the lower face of the anvil assembly 90 such that a variety of tools may be selectively connected to the anvil to accommodate a variety of applications.

Now that the details of the construction of the preferred embodiment have been set forth, consideration will be given to its mode of operation.

OPERATION

With reference to the drawing of FIG. 1, operation is presumed to begin at a point where the cam follower roller 34 is beginning its ascent on the rising portion 50 of the cam profile. The concentrically positioned cylindrical cam 48 is driven by an electric motor 56 in a clockwise direction by the belt and pulley arrangement. As is illustrated, pulley 58 and sprocket 72 are smaller in diameter than their associated respective pulley 62 and sprocket 46 such that a speed reduction is obtained. As the cam rotates in its clockwise direction the cam follower rises upward in the slot 26 and because the cam follower 28 is attached to the side surface of the elongated hammer element 20, the hammer element also rises upward against the force provided by the compression-type helical spring 24. When the cam reaches its maximum stroke, the cam profile falls off sharply at 52 and the hammer element 20 is forced down by the spring 24 and gravity, assuming that the hammer is disposed in a vertical direction as illustrated. When the hammer is in its elevated position, the springs 82 and 84 urge the end of the anvil element 92 upward to the extent permitted by the cooperation of the axial pin 98 and the upper edges of the slots 94 and 96 provided in the tubular housing 16. In this position, the O-ring cushion 100 separates the end of the housing 16 from the anvil extensions. When the hammer element 20 falls, the replaceable driver head 76 strikes the upper end of the anvil 92 and applies an impact force tending to drive the anvil downward against the force of the tension springs 82 and 84. The anvil stroke distance is limited by the cooperation of the transverse pin 98 with the bottom edges of the slots 94 and 96 formed in the tubular housing 16. The driver head 76 may be formed from a suitable material such as hard rubber to prevent metal-tometal contact between the end of the hammer 20 and the top of the anvil 92. The return stroke of the anvil assembly 90 is cushioned by the presence of the O-ring 100.

Because of the concentric arrangement of the cylindrical cam with respect to the hammer 20 and its housing 16, the vibrational forces occurring as the follower hits the bottom of the cam profile 54 are concentrated along the axis of the hammer, which is a significant advantage over prior art arrangements wherein the cam is offset from the axis of the hammer.

ALTERNATIVE DRIVE ARRANGEMENTS

In the event that electric power is not readily available at the location where the power hammer of this invention is to be used, the preferred embodiment of FIG. 1 may be modified slightly to permit its use with alternative sources of rotational power, such as a flex-shaft coupled to an internal combustion engine or the hydraulic pump commonly formed on tractors or other like work vehicles.

FIG. 3 is a fragmentary view showing the way in which a flex-shaft drive may be coupled to the power hammer. In this event, the electric motor 56, the pulley 58, the belt 60 and the pulley 62 depicted in FIG. 1 would be eliminated and the lower end of the jack shaft 70, which is journaled in the pillow blocks 64 and 66, is provided with a slot (not shown) within the nipple type coupling 104. The slot cooperates with a pin (not shown) affixed to the end of the flexible cable 106 contained within an outer sheath 108. The cable 106, in turn, is coupled at its other end to a source of rotational power such as a drive shaft of a gasoline engine.

Figure 4:
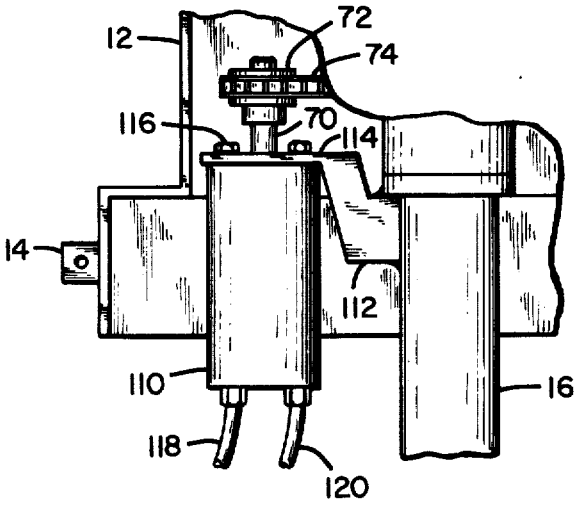
FIG. 4 is another fragmentary view showing the manner in which a hydraulic motor may be used as the source of power.

FIG. 4 illustrates the manner in which a hydraulic motor 110 may be employed to drive the power hammer. Again, when this type of drive is utilized, the assembly including the electric motor 56, the pulleys 58 and 62 and the V-belt 60 shown in FIG. 1 are eliminated. Instead, a bracket 112 which is welded or otherwise attached to the housing 16 is included. The bracket 112 includes a surface which is perpendicular to the axis of the housing 16 and the shaft 70 of the hydraulic motor 110 passes through a hole provided in this surface 114. The motor 110 is attached to the surface 114 of bracket 112 by means of bolts 116. The sprocket 72 is attached to the shaft 70 in the same manner as illustrated in FIG. 1 to allow the hydraulic motor 110 to drive the turntable 46 to which the cylindrical cam is attached. The hydraulic lines 118 and 120 are adapted to be coupled at their opposite ends to a source of hydraulic fluid under pressure.

It should also be apparent that the power hammer of this invention will operate when the cam 48 is driven in either the clockwise or the counter-clockwise direction by the power source and drive system utilized, provided due attention is paid to the cam profile used on the cylindrical cam member 48.

Without further description, it is thought that the features and advantages of the invention will be readily apparent to those skilled in the art, and it will, of course, be understood that changes in the form, proportion and minor details of construction may be resorted to, without departing from the spirit of the invention or its scope as set forth in the following claims.

What is claimed is:

1. A power hammer comprising in combination:

(a) a housing including an elongated tubular member;

(b) an elongated hammer element disposed in said elongated tubular member for reciprocating motion therein;

(c) a cylindrical cam having a cam profile including a rising portion terminating in an abrupt drop, said cylindrical cam being concentrically mounted for rotation about said tubular member as an axis;

(d) a cam follower assembly connected to said elongated hammer element and cooperating with said cam profile;

(e) a compression spring disposed in said tubular member urging said cam follower assembly against said cam profile;

(f) means offset from the axis of said elongated tubular member for rotating said cylindrical cam about said tubular member;

(g) an anvil element having a tool receiving bore therein; a first portion partially disposed in said tubular member for reciprocating motion therein and adapted to be struck by said hammer element when said cam follower reaches said abrupt drop portion of the cam profile; a second portion extending outward from the end of said tubular member; and tension springs coupled between said portion of said anvil extending outward from the end of said tubular member and said tubular member for urging said anvil toward said hammer element.

2. Apparatus as in claim 1 wherein said tubular member includes:

(a) longitudinal slots of a predetermined length on opposed sides thereof in the area of the tubular member occupied by said first portion of said anvil element; and (b) a pin extending transversely through said first portion of said anvil element and through said longitudinal slots for limiting the axial travel of said anvil element.

3. Apparatus as in claim 2 and further including:

(a) cushioning means disposed between said second portion of said anvil and the end of said tubular member.

4. Apparatus as in claim 1 wherein said means for rotating said cylindrical cam comprises:

(a) a turntable concentrically disposed about said elongated tubular member and journaled thereto for rotation about said tubular member as an axis;

(b) means attaching said cylindrical cam to said turntable; and (c) a driving means operatively coupled to said turntable.

5. Apparatus as in claim 4 wherein said driving means includes an electric motor having a shaft operably coupled to said turntable.

6. Apparatus as in claim 4 wherein said driving means includes a shaft adapted to be driven by a source of rotational energy, and means operatively coupling said shaft to said turntable.

7. Apparatus as in claim 1 wherein said tubular member includes a longitudinal slot extending through the wall thereof and wherein said cam follower assembly extends through said longitudinal slot for connection to said hammer element.

8. Apparatus as in claim 7 and further including:

(a) a wear bar disposed on the outer surface of said tubular member in proximity to said longitudinal slot; and (b) said cam follower assembly including roller bearing means engaging said wear bar and said cam profile.

* * * * *